US012225945B1

(12) United States Patent
Hu et al.

(10) Patent No.: US 12,225,945 B1
(45) Date of Patent: Feb. 18, 2025

(54) ATOMIZATION DEVICE AND METHOD FOR CONTROLLING ATOMIZATION DEVICE

(71) Applicant: SHENZHEN WOODY VAPES TECHNOLOGY CO., LTD., Guangdong (CN)

(72) Inventors: Zhipeng Hu, Guangdong (CN); Yong Zhou, Guangdong (CN)

(73) Assignee: SHENZHEN WOODY VAPES TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 18/680,561

(22) Filed: May 31, 2024

(30) Foreign Application Priority Data

Jan. 26, 2024 (CN) ..... 202410122965.1

(51) Int. Cl.
*A24F 40/51* (2020.01)
*A24F 40/60* (2020.01)

(52) U.S. Cl.
CPC ..... *A24F 40/51* (2020.01); *A24F 40/60* (2020.01)

(58) Field of Classification Search
CPC ..... A24F 40/50; A24F 40/51; A24F 40/60
See application file for complete search history.

(56) References Cited

U.S. PATENT DOCUMENTS

| | | | | |
|---|---|---|---|---|
| 12,068,686 | B2 * | 8/2024 | Zhou | H02M 3/157 |
| 2019/0166913 | A1 * | 6/2019 | Trzecieski | A61M 15/06 |
| 2020/0000143 | A1 * | 1/2020 | Anderson | G06F 18/22 |
| 2022/0346458 | A1 | 11/2022 | Zominy | |

FOREIGN PATENT DOCUMENTS

| | | | |
|---|---|---|---|
| EP | 3761820 | B1 | 1/2023 |
| KR | 20210088574 | A | 7/2021 |
| KR | 20230157728 | A | 11/2023 |
| WO | 2022139297 | A1 | 6/2022 |
| WO | 2023152496 | A1 | 8/2023 |

OTHER PUBLICATIONS

Search and Examination Report dated Dec. 19, 2024 received in United Kingdom Patent Application No. GB2409533.3.

* cited by examiner

*Primary Examiner* — Hae Moon Hyeon
(74) *Attorney, Agent, or Firm* — Scully, Scott, Murphy & Presser, P.C.

(57) ABSTRACT

An atomization device, a method for controlling the atomization device, and a non-transitory computer-readable storage medium are provided. The method is applicable to the atomization device. The atomization device includes a display module and an inhalation detection module. The display module has m operating modes, where m≥2. The method for controlling the atomization device includes the following. Detect, by the inhalation detection module, an inhalation of a user, and determine a corresponding inhalation parameter according to the inhalation of the user, where the inhalation parameter includes at least one of a number of inhalations in a preset statistical period, a duration of each inhalation, or a total number of inhalations. Control, according to the inhalation parameter, the display module to perform display in a corresponding operating mode.

19 Claims, 4 Drawing Sheets

ATOMIZATION DEVICE AND METHOD FOR CONTROLLING ATOMIZATION DEVICE

CROSS-REFERENCE TO RELATED APPLICATIONS

This application claims priority under 35 U.S.C. § 119(a) to and the benefit of Chinese Patent Application No. 202410122965.1, filed Jan. 26, 2024, the entire disclosure of which is incorporated herein by reference.

TECHNICAL FIELD

The disclosure relates to the technical field of electronic atomizers, and in particular, to an atomization device, a method for controlling the atomization device, and a non-transitory computer-readable storage medium.

BACKGROUND

Electronic cigarettes are electronic products that simulate tobacco smoking, which vaporize, through methods such as atomization, an atomization substrate into vapor for users to inhale. With the continuous development of electronic technologies, the functionality of electronic cigarettes is gradually improved, allowing the users to control the electronic cigarette to obtain different usage experience.

Currently, the light of the existing electronic cigarette operates in a fixed mode, which lights up when inhaling and goes off when not inhaling, with relatively limited functionality and no ability to switch modes.

SUMMARY

In order to solve or at least partially solve the above technical problem, the disclosure provides an atomization device, a method for controlling the atomization device, and a non-transitory computer-readable storage medium.

To achieve the above objective, a first aspect of the disclosure provides a method for controlling an atomization device. The method is applicable to the atomization device. The atomization device includes a display module and an inhalation detection module. The display module has m operating modes, where m≥2. The method for controlling the atomization device includes the following. An inhalation of a user is detected by the inhalation detection module. A corresponding inhalation parameter is determined according to the inhalation of the user. The inhalation parameter includes at least one of a number of inhalations in a preset statistical period, a duration of each inhalation, or a total number of inhalations. According to the inhalation parameter, the display module is controlled to perform display in a corresponding operating mode. The corresponding operating mode is one of the m operating modes.

In the method for controlling the atomization device provided in the disclosure, the inhalation detection module detects the inhalation of the user, the corresponding inhalation parameter is determined according to the inhalation of the user. The display module is controlled to perform display in a corresponding operating mode according to the inhalation parameter. As such, the atomization device can automatically achieve different display effects according to the inhalation of the user, thereby improving the user experience.

In some embodiments, that the inhalation of the user is detected by the inhalation detection module and the corresponding inhalation parameter is determined according to the inhalation of the user include the following. A corresponding detection signal is acquired by detecting, by the inhalation detection module, the inhalation of the user. The inhalation parameter is determined according to a waveform character of the detection signal. The waveform character includes at least one of a voltage value, a frequency, a duration of a level, or a level jump.

In some embodiments, the inhalation parameter includes the number of the inhalations in the preset statistical period. The inhalation parameter is determined according to the waveform character of the detection signal as follows. That one inhalation occurs is determined in response to that the detection signal jumps from a first level to a second level and a duration of the second level is within a preset duration range. The first level is different from the second level. The number of the inhalations in the preset statistical period is obtained by counting a number of inhalations that occur in the preset statistical period.

In some embodiments, the preset duration range is a range of 50 ms to 600 ms.

In some embodiments, the display module includes n display sub-modules. When the display module is in an $i^{th}$ operating mode in the m operating modes, an $i^{th}$ display sub-module in the n display sub-modules is activated and a display sub-module, other than the $i^{th}$ display sub-module, in the n display sub-modules is inactivated, where m≥n≥i≥1. According to the inhalation parameter, the display module is controlled to perform display in the corresponding operating mode as follows. The $i^{th}$ display sub-module is activated and the display sub-module, other than the $i^{th}$ display sub-module, in the n display sub-modules is inactivated in response to that the inhalation parameter is an $i^{th}$ preset inhalation parameter to control the display module to operate in the $i^{th}$ operating mode. Different operating modes correspond to different preset inhalation parameters.

In some embodiments, m>n, and when the display module is in a $m^{th}$ operating mode in the m operating modes, all of the n display sub-modules are inactivated. According to the inhalation parameter, the display module is controlled to perform display in the corresponding operating mode further as follows. All of the n display sub-modules are inactivated in response to that the inhalation parameter is a $m^{th}$ preset inhalation parameter to control the display module to operate in the $m^{th}$ operating mode.

In some embodiments, the display module further includes n switch modules in one-to-one correspondence with the n display sub-modules. For each of the n switch modules, the switch module is electrically connected between an operating power supply and a display sub-module corresponding to the switch module. That the $i^{th}$ display sub-module is activated and the display sub-module, other than the $i^{th}$ display sub-module, in the n display sub-modules is inactivated to enable the display module to operate in the $i^{th}$ operating mode include the following. A switch-on signal is outputted to an $i^{th}$ switch module in the n switch modules to conduct an electrical connection between the operating power supply and the $i^{th}$ display sub-module via the $i^{th}$ switch module. A switch-off signal is outputted to a switch module, other than the $i^{th}$ switch module, in the n switch modules to disconnect, via the switch module, other than the $i^{th}$ switch module, in the n switch modules, an electrical connection between the operating power supply and a display sub-module corresponding to the switch module, other than the $i^{th}$ switch module, in the n switch modules.

In some embodiments, all of the n display sub-modules are inactivated to control the display module to operate in the $m^{th}$ operating mode as follows. A switch-off signal is outputted to each of the n switch modules to disconnect, via the n switch modules, electrical connections between the operating power supply and the n display sub-modules corresponding to the n switch modules.

In some embodiments, for each of the n switch modules, the switch module includes a p-channel metal-oxide-semiconductor (PMOS) field-effect transistor and a resistor. A source of the PMOS field-effect transistor is electrically connected to the operating power supply. A drain of the PMOS field-effect transistor is electrically connected to a display sub-module corresponding to the switch module. A gate of the PMOS field-effect transistor is configured to receive the switch-on signal and the switch-off signal. The resistor is electrically connected between the gate and the source of the PMOS field-effect transistor.

In some embodiments, each of the n display sub-modules is a display screen or a light-emitting diode (LED) light.

In some embodiments, the display module is capable of displaying multiple types of display information. When the display module is in a $j^{th}$ operating mode in the m operating modes, the display module displays a $j^{th}$ type of display information in the multiple types of display information, where $m \geq j \geq 1$. According to the inhalation parameter, the display module is controlled to perform display in the corresponding operating mode as follows. The display module is controlled to display the $j^{th}$ type of display information in the multiple types of display information in response to that the inhalation parameter is a $j^{th}$ preset inhalation parameter.

In some embodiments, the display module includes at least one of a nixie tube display screen, a liquid crystal display (LCD) display screen, an LED display screen, or an organic light-emitting diode (OLED) display screen.

In some embodiments, the display module includes multiple LED light, and the m operating modes include a constant illumination mode, a blinking mode, and a marquee mode.

In some embodiments, the inhalation detection module further includes an airflow sensor.

A second aspect of the disclosure further provides an atomization device. The atomization device includes a display module, an inhalation detection module, and a control module. The control module is electrically connected to both the display module and the inhalation detection module. The control module is configured to execute operations of the method for controlling the atomization device provided in the first aspect.

A third aspect of the disclosure further provides a non-transitory computer-readable storage medium. The non-transitory computer-readable storage medium stores a program which, when executed by a processor, causes the processor to execute operations of the method for controlling the atomization device provided in the first aspect.

Additional aspects and advantages of the disclosure will be given in part in the following illustrations, become apparent in part from the following illustrations, or be learned from practice of the disclosure.

Figure 1:
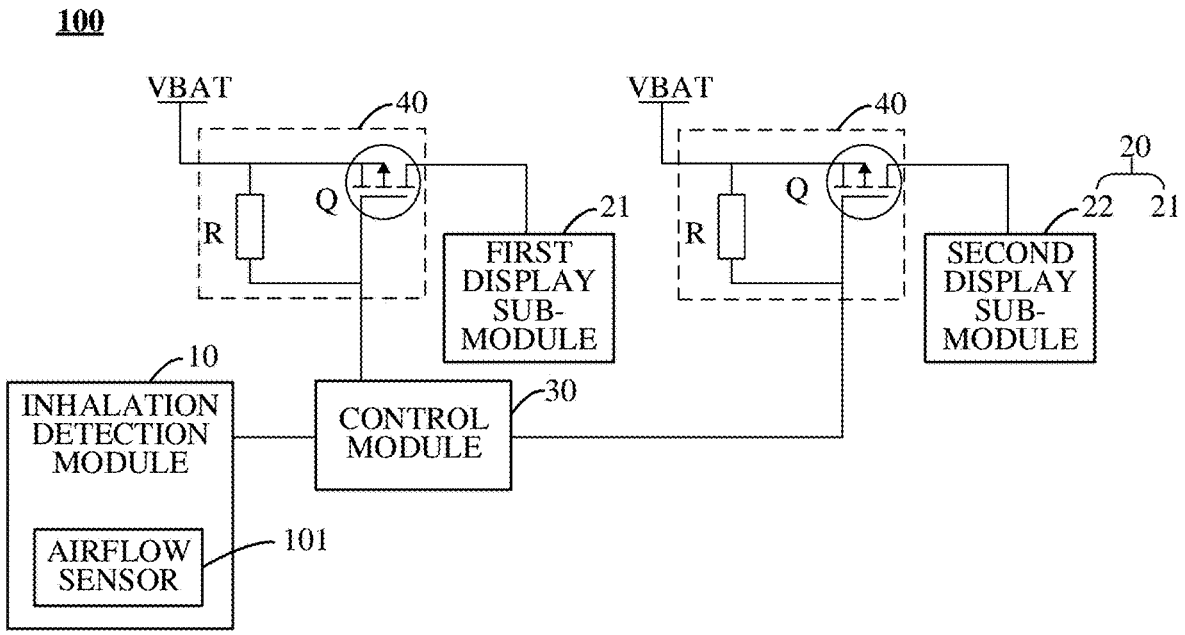
FIG. 1 is a schematic structural diagram of an atomization device provided in embodiments of the disclosure.

Reference numerals are described as follows:

| | |
|---|---|
| atomization device | 100 |
| inhalation detection module | 10 |
| display module | 20 |
| first display sub-module | 21 |
| second display sub-module | 22 |
| control module | 30 |
| switch module | 40 |
| resistor | R |
| PMOS field-effect transistor | Q |
| operating power supply | VBAT |

The following embodiments will describe the disclosure with reference to the accompanying drawings.

DETAILED DESCRIPTION

The technical solutions in the embodiments of the disclosure are clearly and completely described in the following with reference to the accompanying drawings in the embodiments of the disclosure. Apparently, the described embodiments are merely part of rather than all the embodiments of the disclosure. All other embodiments obtained by those of ordinary skill in the art based on the embodiments of the disclosure without creative efforts are within the scope of the disclosure.

In addition, the terms such as "first" and "second" used in the specification of the disclosure are used for distinguishing between similar objects rather than necessarily describing a specific sequence or order. It may be understood that the data used in this manner can be interchangeable in appropriate circumstances, allowing the embodiments of the disclosure described herein can be implemented in sequences other than those illustrated or described herein. Moreover, the terms "include", "comprise", and "have" as well as any variations thereof are intended to cover non-exclusive inclusion. For example, a process, method, system, product, or apparatus including a series of steps or units is not limited to the listed steps or units, it can optionally include other operations or units that are not listed; alternatively, other operations or units inherent to the process, product, or device can be included either.

It is noted that the features of the embodiments in the disclosure can be mutually combined in a condition without inconsistency.

The disclosure provides a method for controlling an atomization device. The method is applicable to the atomization device 100. As illustrated in FIG. 1, the atomization device 100 includes an inhalation detection module 10 and a display module 20. The display module 20 has m operating modes, where $m \geq 2$.

Figure 2:
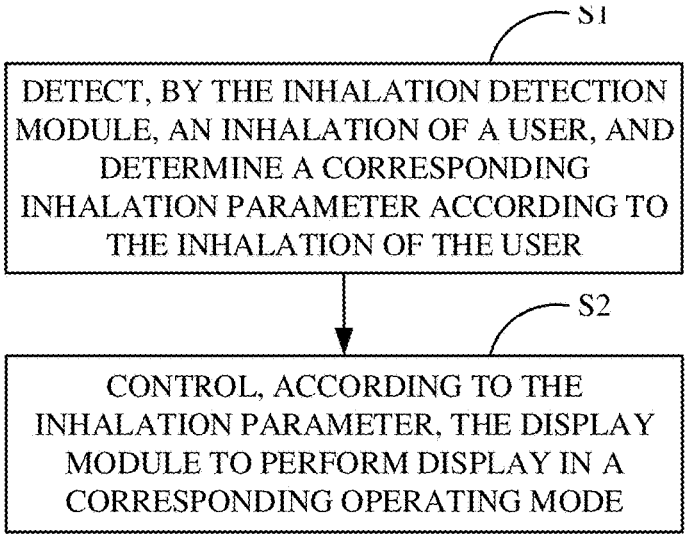
FIG. 2 is a flow chart of a method for controlling an atomization device provided in embodiments of the disclosure.

Referring to FIG. 2, the method for controlling the atomization device 100 includes an operation at S1 and an operation at S2. At S1, an inhalation of a user is detected by the inhalation detection module 10, and a corresponding inhalation parameter is determined according to the inhalation of the user.

The inhalation parameter includes at least one of a number of inhalations in a preset statistical period, a duration of each inhalation, or a total number of inhalations.

In some embodiments, the preset statistical period may be set by the user. For example, the preset statistical period may be 1 s, 2 s, 3 s, 4 s, 5 s, 1 min, 2 min, 3 min, etc., which is not limited herein.

At S2, according to the inhalation parameter, the display module 20 is controlled to perform display in a corresponding operating mode. The corresponding operating mode is one of the m operating modes.

In the method for controlling the atomization device provided in the disclosure, the inhalation detection module 10 detects the inhalation of the user, the corresponding inhalation parameter is determined according to the inhalation of the user. The display module 20 is controlled to perform display in a corresponding operating mode according to the inhalation parameter. As such, the atomization device 100 can automatically achieve different display effects according to the inhalation of the user, thereby improving the user experience.

Figure 3:
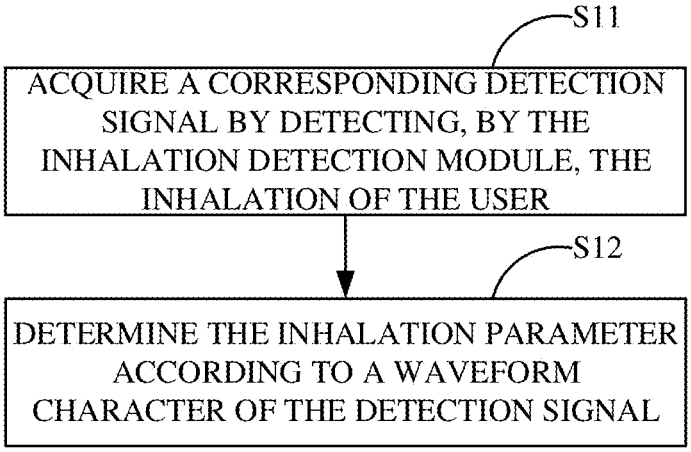
FIG. 3 is a detailed flow chart of an operation at S1 in FIG. 2.

Referring to FIG. 3, in some embodiments, the operation at S1 includes an operation at S11 and an operation at S12. At S11, a corresponding detection signal is acquired by detecting, by the inhalation detection module 10, the inhalation of the user. At S12, the inhalation parameter is determined according to a waveform character of the detection signal.

The waveform character includes at least one of a voltage value, a frequency, a duration of a level, or a level jump.

Exemplarily, referring to FIG. 1, the inhalation detection module 10 may include an airflow sensor 101. The airflow sensor 101 is configured to detect the inhalation of the user. Specifically, the airflow sensor 101 is configured to output a detection signal of a first level is the case where no inhalation is sensed by the airflow sensor 101, and to output a detection signal of a second level in the case where one inhalation is sensed by the airflow sensor 101. As such, whether the user has performed an inhalation can be determined according to a level transition of the detection signal. In addition, a duration of each inhalation can be determined according to a duration of the second level of the detection signal. Moreover, the total number of inhalations of the user can be determined according to the number of level transitions of the detection signal. Optionally, the airflow sensor 101 may include a breath detector. In the case where the user performs an inhalation with the atomization device 100, airflow in the atomization device 100 may be changed, so that the breath detector can output detection signals with different levels according to the change in the airflow. In this way, the inhalation of the user can be identified according to airflow detection signals output by the breath detector.

Figure 4:
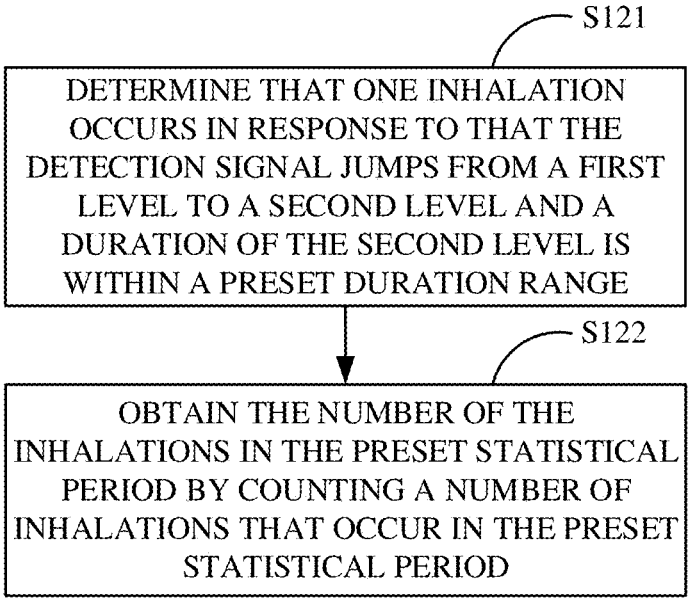
FIG. 4 is a detailed flow chart of an operation at S12 in FIG. 3.

Further, in some embodiments, the inhalation parameters include the number of the inhalations in the preset statistical period. Referring to FIG. 4, the operation at S12 includes an operation at S121 and an operation at S122. At S121, that one inhalation occurs is determined in response to that the detection signal jumps from a first level to a second level and a duration of the second level is within a preset duration range.

The first level is different from the second level.

At S122, the number of the inhalations in the preset statistical period is obtained by counting a number of inhalations that occur in the preset statistical period.

Exemplarily, the preset statistical period is 2 s, where the first level is a low level, the second level is a high level, and the preset duration range is from 50 ms to 600 ms. That is, in the case where the user performs no inhalation with the atomization device 100, the detection signal output by the inhalation detection module 10 is at a low level, and in the case where the user performs one inhalation with the atomization device 100, the detection signal output by the inhalation detection module 10 is at a high level. Here, when the detection signal jumps from the low level to the high level and the duration of the high level is within a range of 50 ms to 600 ms, it is determined that one inhalation occurs. In other embodiments, the preset statistical period may also be another period, the preset duration range may also be another range. Alternatively, the first level may be a high level, and the second level may be a low level, which is not limited herein.

It is found through statistics that a normal duration of a single inhalation that is performed by the user with the atomization device 100 typically falls within the range of 50 ms to 600 ms. Therefore, setting the preset duration range to be a range of 50 ms to 600 ms helps to avoid false detections caused by changes in environmental factors (for example, rapid movement of the atomization device 100 leading to airflow changes), thereby improving an accuracy of detection.

In some embodiments, the display module includes n display sub-modules. When the display module is in an $i^{th}$ operating mode in the m operating modes, an $i^{th}$ display sub-module in the n display sub-modules is activated and a display sub-module, other than the $i^{th}$ display sub-module, in the n display sub-modules is inactivated, where $m \geq n \geq i \geq 1$. In an embodiment, when the display module is in the $i^{th}$ operating mode in the m operating modes, the $i^{th}$ display sub-module in the n display sub-modules is activated and all display sub-modules, other than the $i^{th}$ display sub-module, in the n display sub-modules are inactivated.

In some embodiments, when $m>n$ and the display module 20 is in a $x^{th}$ operating mode in the m operating modes, at least two display sub-modules in the n display sub-modules are activated, or all of the n display sub-modules are inactivated, where $m \geq x > n$.

Figure 5:
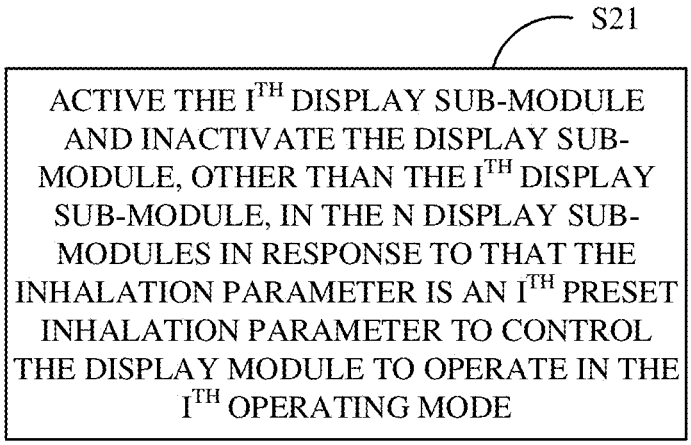
FIG. 5 is a first detailed flow chart of an operation at S2 in FIG. 2.

Referring to FIG. 5, in some embodiments, the operation at S2 includes an operation at S21. At S21, the $i^{th}$ display sub-module is activated and the display sub-module, other than the $i^{th}$ display sub-module, in the n display sub-modules is inactivated in response to that the inhalation parameter is an $i^{th}$ preset inhalation parameter to control the display module to operate in the $i^{th}$ operating mode.

Different operating modes correspond to different preset inhalation parameters.

In some embodiments, the method further includes: inactivating all the n display sub-modules in response to that the display module 20 is in a $m^{th}$ operating mode in the m operating modes, where $m=n+1$.

In some embodiments, the display module 20 is a display screen, and each of the n display sub-modules is an LED light, and different display sub-modules are configured to emit different colored lights.

In some embodiments, the method further includes: turning the display module off in response to that a number of inhalations in a turn-off period is equal to zero, where a duration of the turn-off period is greater than a duration of the preset statistical period.

In some embodiments, the turn-off period may be set by the user.

In some embodiments, the method further includes: turning the display module off in response to that the total number of inhalations is greater than a preset threshold.

Exemplarily, as illustrated in FIG. 1, the display module 20 includes two display sub-modules, that is, a first display sub-module 21 and a second display sub-module 22. The display module 20 has a first operating mode, a second operating mode, and a third operating mode. Exemplarily, the first display sub-module 21 may be a display screen or a light-emitting diode (LED) light, and the second display sub-module 22 may be a display screen or an LED light.

During operation, when the inhalation parameter is a first preset inhalation parameter, the first display sub-module 21 is controlled to perform display and the second display sub-module 22 is controlled not to perform display. When the inhalation parameter is a second preset inhalation parameter, the first display sub-module 21 is controlled not to perform display and the second display sub-module 22 is controlled to perform display. When the inhalation parameter is a third preset inhalation parameter, both the first display sub-module 21 and the second display sub-module 22 are controlled to perform display. In other embodiments, the number of the display sub-modules in the display module 20 may also be 3, 4, 5, etc.

Figure 6:
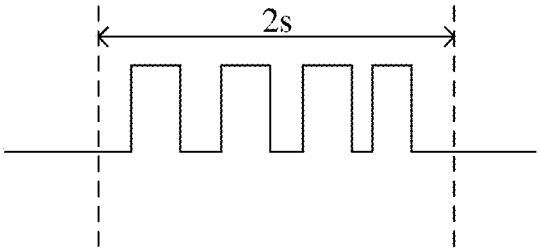
FIG. 6 is a schematic diagram of a detection signal output by an inhalation detection module provided in embodiments of the disclosure.

Exemplarily, the inhalation parameter may be the number of the inhalations within 2 s. For example, the first preset inhalation parameter may be two inhalations within 2 s, that is, the user performs inhalation twice within 2 s. The second preset inhalation parameter may be three inhalations within 2 s, that is, the user performs inhalation three times within 2 s. The third preset inhalation parameter may be four inhalations within 2 s, that is, the user performs inhalation fourth times within 2 s. For example, as illustrated in FIG. 6, one pulse represents one inhalation, and the detection signal has four pulses within 2 s, so that it indicates that there are four inhalations within 2 s. As such, the user can know a frequency of inhalations of the user according to the operating mode of the display module 20.

Exemplarily, the inhalation parameter may also be the duration of each inhalation. For example, the first preset inhalation parameter may be a duration ranging from 0 ms to 50 ms for a single inhalation, that is, a duration of a single inhalation performed by the user ranges from 0 ms to 50 ms. The second preset inhalation parameter may be a duration ranging from 50 ms to 600 ms for a single inhalation, that is, a duration of a single inhalation performed by the user ranges from 50 ms to 600 ms. The third preset inhalation parameter may be a duration not less than 600 ms for a single inhalation, that is, a duration of a single inhalation performed by the user is not less than 600 ms. As such, the user can know the duration of each inhalation according to the operating mode of the display module 20.

Exemplarily, the inhalation parameter may also be the total number of inhalations. For example, the first preset inhalation parameter may be a total number of inhalations ranging from 0 to 10, that is, a total number of inhalations performed by the user ranges from 0 to 10. The second preset inhalation parameter may be a total number of inhalations ranging from 11 to 30, that is, a total number of inhalations performed by the user ranges from 11 to 30. The third preset inhalation parameter may be a total number of inhalations ranging from 31 to 50, that is, a total number of inhalations performed by the user ranges from 31 to 50. As such, the user can know the total number of inhalations of the user, allowing timely replacement of the e-liquid or the cartridge according to the total number of inhalations by the user.

In some embodiments, the display module 20 further includes n switch modules 40 in one-to-one correspondence with the n display sub-modules. For each of the n switch modules 40, the switch module 40 is electrically connected between an operating power supply VBAT and a display sub-module corresponding to the switch module 40.

Figure 7:
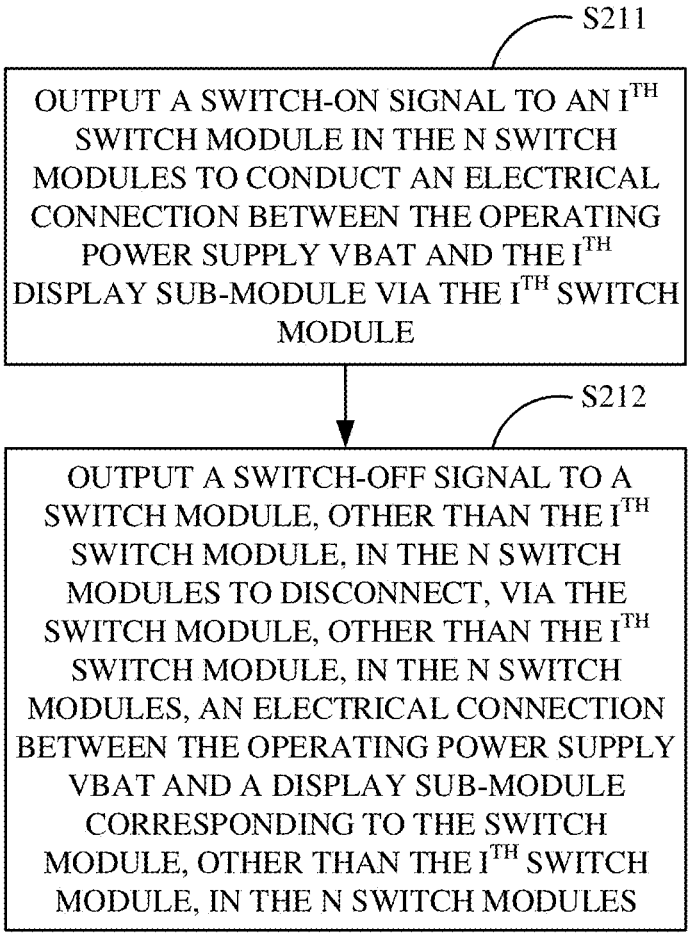
FIG. 7 is a detailed flow chart of an operation at S21 in FIG. 5.

Referring to FIG. 7, in some embodiments, the operation at S21 includes an operation at S211 and an operation at S212. At S211, a switch-on signal is outputted to an $i^{th}$ switch module 40 in the n switch modules 40 to conduct an electrical connection between the operating power supply VBAT and the $i^{th}$ display sub-module via the $i^{th}$ switch module 40.

Thus, the $i^{th}$ display sub-module can be powered to perform display by switching the $i^{th}$ switch module 40 on.

At S212, a switch-off signal is outputted to a switch module 40, other than the $i^{th}$ switch module 40, in the n switch modules 40 to disconnect, via the switch module 40, other than the $i^{th}$ switch module 40, in the n switch modules 40, an electrical connection between the operating power supply VBAT and a display sub-module corresponding to the switch module 40, other than the $i^{th}$ switch module 40, in the n switch modules 40.

In this way, by disconnecting the switch modules 40, other than the $i^{th}$ switch module 40, in the n switch modules 40, all display sub-modules other than the $i^{th}$ display sub-module can be powered off to not perform display.

An execution sequence of the operation at S211 and the operation at S212 is not limited herein. The operation at S211 and the operation at S212 may be executed simultaneously. Alternatively, the operation at S211 may be executed before the operation at S212. Alternatively, the operation at S212 may be executed before the operation at S211.

Further, in some embodiments, $m>n\geq i\geq 1$, when the display module is in a $m^{th}$ operating mode in the m operating modes, all of the n display sub-modules are inactivated.

In some embodiments, the operation at S2 includes an operation at S22.

At S22, all of the n display sub-modules are inactivated in response to that the inhalation parameter is a $m^{th}$ preset inhalation parameter to control the display module to operate in the $m^{th}$ operating mode.

Further, the operation at S22 includes an operation at S221.

At S221, a switch-off signal is outputted to each of the n switch modules to disconnect, via the n switch modules, electrical connections between the operating power supply and the n display sub-modules corresponding to the n switch modules.

As illustrated in FIG. 1, in some embodiments, each of the switch modules 40 includes a p-channel metal-oxide-semiconductor (PMOS) field-effect transistor Q and a resistor R.

A source of the PMOS field-effect transistor Q is electrically connected to the operating power supply VBAT. A drain of the PMOS field-effect transistor Q is electrically connected to a display sub-module corresponding to the switch module. A gate of the PMOS field-effect transistor Q is configured to receive the switch-on signal and the switch-off signal.

The resistor is electrically connected between the gate and the source of the PMOS field-effect transistor Q.

During operation, the PMOS field-effect transistor Q is configured to conduct an electrical connection between the display sub-module corresponding to the switch module 40 and the operating power supply VBAT in response to the switch-on signal, and to disconnect the electrical connection between the display sub-module corresponding to the switch module 40 and the operating power supply VBAT in response to the switch-off signal. The switch-on signal is a low level signal, and the switch-off signal is a high level signal.

In some embodiments, the display module 20 is capable of displaying multiple types of display information. When the display module 20 is in a $j^{th}$ operating mode in the m operating modes, the display module 20 displays a $j^{th}$ type of display information in the multiple types of display information, where $m \geq j \geq 1$.

Figure 8:
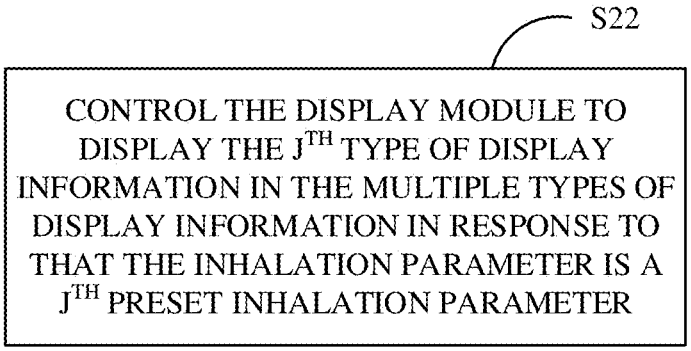
FIG. 8 is a second detailed flow chart of an operation at S2 in FIG. 2.

Referring to FIG. 8, in some embodiments, the operation at S2 includes an operation at S22. At S22, the display module 20 is controlled to display the $j^{th}$ type of display information in the multiple types of display information in response to that the inhalation parameter is a $j^{th}$ preset inhalation parameter.

In some embodiments, the display module 20 may include multiple LED lights. The m operating modes of the display module 20 may include a constant illumination mode, a blinking mode, a marquee mode, and the like. In other embodiments, the display module 20 may also be a display screen, such as a nixie tube display screen, a liquid crystal display (LCD) display screen, an LED display screen, an organic light-emitting diode (OLED) display screen, etc. The m operating modes of the display module 20 may include a screen-on mode, a screen-off mode, an operating mode for displaying different display pictures according to different inhalation parameters, etc.

Referring to FIG. 1 again, based on the same inventive concept, the disclosure further provides an atomization device 100. The atomization device 100 includes an inhalation detection module 10, a display module 20, and a control module 30.

The control module 30 is electrically connected to both the display module 20 and the inhalation detection module 10. The control module 30 is configured to execute operations of the method for controlling the atomization device according to any one of the above embodiments.

Exemplarily, the control module 30 is a processor. The processor may be composed of integrated circuits. For example, the processor may be composed of a single packaged integrated circuit, or may be composed of multiple integrated circuits packaged with the same function or different functions. The processor may include one or more central processing units (CPUs), microcontroller units (MCUs), digital signal processing (DSP) chips, complex programmable logic devices (CPLD) chips, field programmable gate array (FPGA) chips, single chip microcomputers, combinations of various control chips, and the like.

In some embodiments, the control module 30 is configured to detect an inhalation of a user through the inhalation detection module 10, to determine a corresponding inhalation parameter according to the inhalation of the user, and to control the display module 20 to perform display in a corresponding operating mode according to the inhalation parameter. The corresponding operating mode is one of the m operating modes.

In some embodiments, the control module 30 is configured to acquire a corresponding detection signal by detecting, by the inhalation detection module 10, the inhalation of the user, and to determine the inhalation parameter according to a waveform character of the detection signal.

In some embodiments, the control module 30 is configured to determine that one inhalation occurs in response to that the detection signal jumps from a first level to a second level and a duration of the second level is within a preset duration range, and to obtain the number of the inhalations in the preset statistical period by counting a number of inhalations that occur in the preset statistical period.

In some embodiments, the control module 30 is configured to active an $i^{th}$ display sub-module and inactivate a display sub-module, other than the $i^{th}$ display sub-module, in n display sub-modules in response to that the inhalation parameter is an $i^{th}$ preset inhalation parameter to control the display module 20 to operate in an $i^{th}$ operating mode.

In some embodiments, the control module 30 is configured to output a switch-on signal to an $i^{th}$ switch module 40 in n switch modules 40 to conduct an electrical connection between the operating power supply VBAT and the $i^{th}$ display sub-module via the $i^{th}$ switch module 40, and to output a switch-off signal to a switch module, other than the $i^{th}$ switch module, in the n switch modules to disconnect, via the switch module, other than the $i^{th}$ switch module, in the n switch modules, an electrical connection between the operating power supply VBAT and a display sub-module corresponding to the switch module 40, other than the $i^{th}$ switch module 40, in the n switch modules 40, so that the display module 20 can operate in the $i^{th}$ operating mode.

In some embodiments, the control module 30 is configured to control the display module 20 to display the $j^{th}$ type of display information in the multiple types of display information in response to that the inhalation parameter is a $j^{th}$ preset inhalation parameter.

The atomization device 100 provided in the disclosure corresponds to the described method for controlling the atomization device, and the detailed illustrations can refer to the described embodiments of the method for controlling the atomization device.

Based on the same inventive concept, the disclosure further provides a non-transitory computer-readable storage medium. The non-transitory computer-readable storage medium stores a program which, when executed by a processor, causes the processor to execute operations of the method for controlling the atomization device of any one of the above embodiments.

In the atomization device 100 and the non-transitory computer-readable storage medium provided in the disclosure, the inhalation detection module 10 detects the inhalation of the user, the corresponding inhalation parameter is determined according to the inhalation of the user. The display module 20 is controlled to perform display in a corresponding operating mode according to the inhalation parameter. As such, the atomization device 100 can automatically achieve different display effects according to the inhalation of the user, thereby improving the user experience.

Those skilled in the art will understand that embodiments herein can provide a method, a system, or a computer program product. Therefore, the disclosure may have hardware-only embodiments, software-only embodiments, or software plus hardware embodiments. In addition, the disclosure may be implemented in the form of a computer program product embodied on one or more computer usable storage media (including but not limited to a disk storage, compact disc read-only memory (CD-ROM), an optical memory, and the like) including computer usable program codes.

The disclosure is described herein with reference to schematic flow charts and/or block diagrams of methods, apparatuses (systems), and computer program products according to the embodiments of the disclosure. It may be understood that each flow and/or block in the flow charts and/or the block diagrams, as well as a combination of flow and/or block in the flowcharts and/or the block diagrams can be implemented by computer program instructions. These computer program instructions may be provided to a general purpose computer, a special purpose computer, an embedded processor, or a processor of other programmable data processing apparatuses to form a machine, such that devices for implementing functions specified by one or more flows in the flowcharts and/or one or more blocks in the block diagrams may be generated by executing the instructions with the processor of the computer or other programmable data processing apparatuses.

The computer program instructions may also be stored in a computer-readable memory that can direct the computer or other programmable data processing apparatuses to operate in a given manner, so that the instructions stored in the computer-readable memory produce a manufactured article including an instruction device, and the instruction device implements the functions specified by one or more flows in the flowchart and/or one or more blocks in the block diagram.

The computer program instructions may also be loaded onto the computer or other programmable data processing apparatuses, such that a series of process steps may be executed on the computer or other programmable apparatuses to produce processing implemented by the computer, so that the instructions executed on the computer or other programmable apparatuses provide steps for implementing the functions specified by one or more flows in the flow charts and/or one or more blocks in the block diagram.

The memory may include a non-permanent memory in a non-transitory computer-readable storage medium in the form of a random access memory (RAM), and/or a non-volatile memory (such as a read-only memory (ROM) and a flash RAM), etc. The memory is an example of a non-transitory computer-readable storage medium.

Computer-readable storage media, including permanent and non-permanent, removable and non-removable media, may implement information storage by any method or technology. The information may include computer-readable instructions, data structures, modules of a program, or other data. Examples of computer storage media include, but not limited to phase change memory (PRAM), static random access memory (SRAM), dynamic random access memory (DRAM), other types of RAM, ROM, electrically erasable programmable read-only memory (EEPROM), flash memory or other memory technology, CD-ROM, digital versatile discs (DVD) or other optical storage, magnetic cassettes, magnetic tape magnetic disk storage, or other magnetic storage devices, or any other non-transmission medium, may be used to store information that may be accessed by a computing device. As defined herein, the non-transitory computer-readable storage medium does not include transitory computer-readable media, such as modulated data signals and carrier waves.

Although the embodiments of the disclosure have been illustrated and described, those skilled in the art will understand that various changes, modifications, substitutions, and modifications can be made to these embodiments without departing from the principle and spirit of the disclosure, and the scope of the disclosure is defined by the appended claims and their equivalents.

The invention claimed is:

1. A method for controlling an atomization device, wherein the atomization device comprises a display module, an inhalation detection module, and a control module electrically connected to both the display module and the inhalation detection module, the display module has m operating modes, m≥2, and the method for controlling the atomization device comprises:

detecting, by the inhalation detection module, an inhalation of a user, and determining, by the control module, a corresponding inhalation parameter according to the inhalation of the user, wherein the inhalation parameter comprises at least one of a number of inhalations in a preset statistical period, a duration of each inhalation, or a total number of inhalations; and controlling, by the control module according to the inhalation parameter, the display module to perform display in a corresponding operating mode, wherein the corresponding operating mode is one of the m operating modes.

2. The method for controlling the atomization device of claim 1, wherein detecting, by the inhalation detection module, the inhalation of the user, and determining the corresponding inhalation parameter according to the inhalation of the user, comprise:

acquiring a corresponding detection signal by detecting, by the inhalation detection module, the inhalation of the user; and determining the inhalation parameter according to a waveform character of the detection signal, wherein the waveform character comprises at least one of a voltage value, a frequency, a duration of a level, or a level jump.

3. The method for controlling the atomization device of claim 2, wherein the inhalation parameter comprises the number of the inhalations in the preset statistical period, and determining the inhalation parameter according to the waveform character of the detection signal comprises:

determining that one inhalation occurs in response to that the detection signal jumps from a first level to a second level and a duration of the second level is within a preset duration range, wherein the first level is different from the second level; and obtaining the number of the inhalations in the preset statistical period by counting a number of inhalations that occur in the preset statistical period.

4. The method for controlling the atomization device of claim 3, wherein the preset duration range is a range of 50 ms to 600 ms.

5. The method for controlling the atomization device of claim 1, wherein the display module comprises n display sub-modules, and when the display module is in an $i^{th}$ operating mode in the m operating modes, an $i^{th}$ display sub-module in the n display sub-modules is activated and a display sub-module, other than the $i^{th}$ display sub-module, in the n display sub-modules is inactivated, wherein m≥n≥i≥1; and controlling, according to the inhalation parameter, the display module to perform display in the corresponding operating mode comprises:

activating the $i^{th}$ display sub-module and inactivating the display sub-module, other than the $i^{th}$ display sub-module, in the n display sub-modules, in response to that the inhalation parameter is an $i^{th}$ preset inhalation parameter, to control the display module to operate in the $i^{th}$ operating mode, wherein different operating modes correspond to different preset inhalation parameters.

6. The method for controlling the atomization device of claim 5, wherein m>n, and when the display module is in a $m^{th}$ operating mode in the m operating modes, all of the n display sub-modules are inactivated;

controlling, according to the inhalation parameter, the display module to perform display in the corresponding operating mode further comprises:

inactivating all of the n display sub-modules, in response to that the inhalation parameter is a $m^{th}$ preset inhalation parameter, to control the display module to operate in the $m^{th}$ operating mode.

7. The method for controlling the atomization device of claim 6, wherein the display module further comprises n switch modules in one-to-one correspondence with the n display sub-modules, and for each of the n switch modules, the switch module is electrically connected between an operating power supply and a display sub-module corresponding to the switch module;

activating the $i^{th}$ display sub-module and inactivating the display sub-module, other than the $i^{th}$ display sub-module, in the n display sub-modules to enable the display module to operate in the $i^{th}$ operating mode, comprises:

outputting a switch-on signal to an $i^{th}$ switch module in the n switch modules to conduct an electrical connection between the operating power supply and the $i^{th}$ display sub-module via the $i^{th}$ switch module; and outputting a switch-off signal to a switch module, other than the $i^{th}$ switch module, in the n switch modules to disconnect, via the switch module, other than the $i^{th}$ switch module, in the n switch modules, an electrical connection between the operating power supply and a display sub-module corresponding to the switch module, other than the $i^{th}$ switch module, in the n switch modules.

8. The method for controlling the atomization device of claim 7, wherein inactivating all of the n display sub-modules to control the display module to operate in the $m^{th}$ operating mode comprises:

outputting a switch-off signal to each of the n switch modules to disconnect, via the n switch modules, electrical connections between the operating power supply and the n display sub-modules corresponding to the n switch modules.

9. The method for controlling the atomization device of claim 8, wherein for each of the n switch modules, the switch module comprises:

a p-channel metal-oxide-semiconductor (PMOS) field-effect transistor, wherein a source of the PMOS field-effect transistor is electrically connected to the operating power supply, a drain of the PMOS field-effect transistor is electrically connected to a display sub-module corresponding to the switch module, and a gate of the PMOS field-effect transistor is configured to receive the switch-on signal and the switch-off signal; and a resistor electrically connected between the gate and the source of the PMOS field-effect transistor.

10. The method for controlling the atomization device of claim 5, wherein each of the n display sub-modules is a display screen or a light-emitting diode (LED) light.

11. The method for controlling the atomization device of claim 1, wherein the display module is capable of displaying a plurality of types of display information, and when the display module is in a $j^{th}$ operating mode in the m operating modes, the display module displays a $j^{th}$ type of display information in the plurality of types of display information, wherein m≥j≥1; and controlling, according to the inhalation parameter, the display module to perform display in the corresponding operating mode comprises:

controlling the display module to display the $j^{th}$ type of display information in the plurality of types of display information in response to that the inhalation parameter is a $j^{th}$ preset inhalation parameter.

12. The method for controlling the atomization device of claim 11, wherein the display module comprises at least one of a nixie tube display screen, a liquid crystal display (LCD) display screen, a light-emitting diode (LED) display screen, or an organic light-emitting diode (OLED) display screen.

13. The method for controlling the atomization device of claim 11, wherein the display module comprises a plurality of LED light, and the m operating modes comprise a constant illumination mode, a blinking mode, and a marquee mode.

14. The method for controlling the atomization device of claim 1, wherein the inhalation detection module further comprises an airflow sensor.

15. The method for controlling the atomization device of claim 1, further comprising:

turning the display module off in response to that a number of inhalations in a turn-off period is equal to zero, wherein a duration of the turn-off period is greater than a duration of the preset statistical period.

16. The method for controlling the atomization device of claim 1, further comprising:

turning the display module off in response to that the total number of inhalations is greater than a preset threshold.

17. An atomization device comprising:

a display module;

an inhalation detection module;

a control module electrically connected to both the display module and the inhalation detection module, wherein the control module is configured to execute operations of a method for controlling the atomization device, the display module has m operating modes, m≥2, and the method for controlling the atomization device comprises:

detecting, by the inhalation detection module, an inhalation of a user, and determining, by the control module, a corresponding inhalation parameter according to the inhalation of the user, wherein the inhalation parameter comprises at least one of a number of inhalations in a preset statistical period, a duration of each inhalation, or a total number of inhalations; and controlling, by the control module according to the inhalation parameter, the display module to perform display in a corresponding operating mode, wherein the corresponding operating mode is one of the m operating modes.

18. The atomization device of claim 17, wherein detecting, by the inhalation detection module, the inhalation of the user, and determining the corresponding inhalation parameter according to the inhalation of the user, comprise:

acquiring a corresponding detection signal by detecting, by the inhalation detection module, the inhalation of the user; and determining the inhalation parameter according to a waveform character of the detection signal, wherein the waveform character comprises at least one of a voltage value, a frequency, a duration of a level, or a level jump.

19. The atomization device of claim 18, wherein the inhalation parameter comprises the number of the inhalations in the preset statistical period, and determining the inhalation parameter according to the waveform character of the detection signal comprises:

determining that one inhalation occurs in response to that the detection signal jumps from a first level to a second level and a duration of the second level is within a preset duration range, wherein the first level is different from the second level; and obtaining the number of the inhalations in the preset statistical period by counting a number of inhalations that occur in the preset statistical period.

* * * * *